US006739233B2

(12) United States Patent
Malakatas

(10) Patent No.: US 6,739,233 B2
(45) Date of Patent: May 25, 2004

(54) METHOD AND DEVICE FOR JUDGING AIMING ERRORS OF A WEAPON SYSTEM AND USE OF THE DEVICE

(75) Inventor: Nicolas Malakatas, Zürich (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 10/302,179

(22) Filed: Nov. 22, 2002

(65) Prior Publication Data

US 2003/0140774 A1 Jul. 31, 2003

(30) Foreign Application Priority Data

Nov. 23, 2001 (CH) ..... 2168/01

(51) Int. Cl.[7] ..... F41G 3/00

(52) U.S. Cl. ..... 89/41.01; 89/41.04; 89/41.05; 89/41.03

(58) Field of Search ..... 89/1.11, 41.01, 89/41.03, 41.04, 41.05, 41.07, 41.14, 41.17, 41.22, 204, 205; 33/235

(56) References Cited

U.S. PATENT DOCUMENTS

| | | | | |
|---|---|---|---|---|
| 3,981,010 A | | 9/1976 | Michelsen | |
| 4,145,952 A | * | 3/1979 | Tye | 89/41.21 |
| 4,402,250 A | * | 9/1983 | Baasch | 89/41.11 |
| 4,429,993 A | | 2/1984 | Schick | |
| 4,878,752 A | | 11/1989 | Bramley | |
| 5,208,418 A | | 5/1993 | Toth | |
| 5,464,174 A | * | 11/1995 | Laures | 244/3.11 |
| 6,491,253 B1 | * | 12/2002 | McIngvale | 244/3.11 |
| 6,584,879 B2 | * | 7/2003 | Gorman | 89/1.11 |
| 2001/0047248 A1 | | 11/2001 | Toth | |

FOREIGN PATENT DOCUMENTS

| | | | |
|---|---|---|---|
| EP | 1 152 206 A1 | 11/2001 | |
| GB | 2077400 A * | 12/1981 | F41G/3/00 |
| WO | WO 88/08952 | 11/1988 | |

* cited by examiner

*Primary Examiner*—Michael J. Carone
*Assistant Examiner*—Gabriel S Sukman
(74) *Attorney, Agent, or Firm*—McCormick, Paulding & Huber LLP

(57) ABSTRACT

A method and device for judging the aiming error of a weapon system and a use of the device are disclosed. The weapon system includes a fire control device (F) for tracking a target (Z), a weapon (W) having a weapon barrel (B), aiming means for aiming the weapon barrel (B), and a data processing facility (EDV). The fire control device (F) tracks the target (Z), the data processing facility (EDV) continuously performs a lead calculation, and the weapon barrel (B) is aimed on the basis of the lead calculation. From the weapon (W), the data processing facility (EDV) receives a signal about the actual direction (βeff) of the aimed weapon barrel (B) from the view of the weapon (W). It calculates the intended direction (β*) for the weapon barrel (B) from the view of the weapon (W), as well as the aiming error (ρ) as a difference between the actual direction (βeff) and the intended direction (β*). An image recording device (V) records images of the target (Z). An image reproduction device (M) visualizes the recorded images as well as a deviation mark (Y) in a deviation (b) from a reference point (O), this deviation (b) being correlated to the aiming error (ρ).

16 Claims, 5 Drawing Sheets

METHOD AND DEVICE FOR JUDGING AIMING ERRORS OF A WEAPON SYSTEM AND USE OF THE DEVICE

CROSS REFERENCE TO RELATED APPLICATION

Applicant hereby claims foreign priority under 35 U.S.C. § 119 from Swiss Patent Application No. 2001 2168/01, filed Nov. 23, 2001, the disclosure of which is herein incorporated by reference.

BACKGROUND OF THE INVENTION

The present invention relates to a method and device for judging the aiming errors of a weapon system, which has a fire control device for tracking a target, a weapon having a weapon barrel, aiming means for aiming the weapon barrel, and a data processing facility having software.

Methods and devices of this type are used for the purpose of judging the aiming precision of weapon systems, which are used to combat rapidly moving targets, generally flying targets.

Such weapons systems include a fire control device and one or more guns assigned to the fire control device. The fire control device is intended for the purpose of detecting a target, acquiring it, and tracking it. During tracking of the target, measurements are performed almost continuously, i.e., at measurement instants lying very near one another in time, in order to establish the location of the target for each measurement instant. A data processing unit assigned to the weapon system retrospectively calculates the movement state of the target from the results of these measurements, this movement state understood to include at least one empirical travel/time function, one empirical speed/time function, and one acceleration/time function of the target. Furthermore, the computer unit calculates the future movement state of the target on the basis of the travel/time function, the speed/time function, and the acceleration/time function. This is an extrapolation, i.e., the actual future movement state of the target is not calculated, but rather the movement state which the target will presumably have and which is also referred to as the expected movement state of the target. In particular a due instant and an associated due position, at which the target is expected at the due instant, are calculated. The due position is determined in such a way that a shell which is fired at a specific firing instant by the weapon arrives at the due position at the due instant or, expressed simply, hits the target. The due position determined in this way is therefore the expected meeting point of target and shell. In connection with this, the data processing unit also calculates an aiming point for the weapon and/or for the weapon barrel, at which the weapon barrel must be aimed in the firing instant of the shell, and/or an azimuth and an elevation which the weapon barrel must have in the firing instant. In this calculation, which is referred to as a lead calculation, the relative positions of the fire control device and the weapon, the internal and external ballistics, and delays, which result during the functioning of the system, are taken into consideration. Obviously, the firing instant, in which the weapon barrel must be aimed at the aiming point, is before the due instant, in which the target will be located at the due position.

In order to judge the serviceability of the weapon system, the accuracy performance is tested. In this case, it is essentially checked whether the procedures between the tracking of the target and the firing of a shell run as planned, specifically in such a way that the target and shell are located at the due position in the due instant, or at least in its close surroundings. Various methods are known for determining aiming errors. However, really appropriate judgment of the accuracy performance of a weapon system is only possible if the combating of a target is actually performed or is simulated in a way close to reality.

Precise judgment of the aiming precision and/or precise determination of aiming errors may be performed, for example, by actually firing at a target and determining the angular and/or distance deviation of the shell from the target during its flight. However, the judgment of the aiming precision and/or the accuracy performance is restricted to a relatively narrow time window during shelling and does not provide any points of reference about possible hits during the remaining span of time in which the target may be combated. A manipulated target and/or practice target is used as the target, which is to behave at least approximately like the real targets which the weapon system is intended to combat. Such manipulated targets are unmanned. Self-flying manipulated targets or drones, which may be remote-controlled, are known, as are non-flying manipulated targets, which are, for example, pulled by a towing aircraft. Live ammunition or practice ammunition may be used as ammunition. The deviation may be established in two different ways: either the travel/time curves of both the manipulated target and shell are determined end the deviation of the shell from the manipulated target is established therefrom; for this purpose, for example, the localized region in which the manipulated target and the shell meet may be imaged in the time period in which this impact occurs and the deviation may be determined therefrom. Or, sensors are attached to the manipulated target, which react to shells flying by. The great disadvantage of this method is that it is very complicated and costly. Independently of whether self-flying or towed manipulated targets are used, these manipulated targets themselves are necessary, as well as either additional devices for establishing and measuring the flight paths and for evaluating the measurement values established in this case, or devices for processing the signals made available by the sensors. The use of unmanned, flying, remote-controlled manipulated targets requires additional terrestrial devices for remote control of these manipulated targets. The totality of the devices required is, in any case, as indicated above, costly to provide and complicated to operate; typically, these devices may only be operated by specialized personnel and require an infrastructure which is only available at fixed firing ranges, but not in the field. In addition, there is always the danger of damaging or destroying the manipulated targets, which may not be avoided and should not be avoided, since hitting the manipulated target documents precisely the good aiming precision which is sought.

While in the method described above, manipulated targets are used as targets and real flight paths actually flown through by shells are assigned for the judgment, in the method described in the following, known as "zero test", real targets or manipulated targets may be used as desired; the flight paths of the shells are optically simulated, the simulated beams only corresponding to the simulated shell flight paths at their starting and ending points. The zero test only verifies whether the tracking of the target by the fire control device and the aiming of the weapon barrel controlled by the fire control device at the target runs without errors, but the actual lead calculation is not checked.

For the zero test, the tracking of the target is performed as usual by the fire control device. The weapon barrel is continuously tracked on the target in such a way that it is continuously aimed at the target. The target is not fired upon, but rather a video camera mounted on the weapon barrel records images of the target. These images are visualized immediately or later. The aiming line, i.e., a line in the extension of the weapon barrel axis, is represented in the displayed images by a mark. The aiming error appears as a deviation of the image of the target from this mark. The target, which may be a real target in the zero test, is therefore not fired upon using shells, but rather the shelling is simulated in a way by optical beams; however, during the simulation a beam is recorded and visualized which runs not from the weapon to the target, but from the target to the weapon, this, however, being unimportant for the method. During the zero test, the weapon is directly tracked on the target, i.e., azimuth and elevation are such that for perfect aiming precision, the weapon barrel is aimed directly at the target; during visualization of the images of the video camera, the target is always on the mark. Since in reality the aiming precision is not perfect, but rather certain aiming errors occur, the image of the target is generally not on the mark during visualization of the images of the video camera. The deviation of the image of the target from the mark corresponds to the deviation of the shell from the target. The zero test is based on the fiction that shells without mass are used, which pass through their flight path with infinite shell speed, so that the shell flight time from the weapon barrel to the target is zero, which also explains the name "zero test". Lead and the inclusion of internal ballistic variables of the shell are not taken into consideration by the data processing unit assigned to the weapon system in the calculations of azimuth and elevation and/or the control of the weapon barrel; they also actually do not play a role within the fiction of the infinite shell speed. The advantage of the zero test is that the additional devices necessary are not costly, and the performance of the test is simple, so that no specialized personnel have to be used and the test may be performed not only on firing ranges, but also in the field. The simplifications which occur for the zero test, i.e., the masking of all facts which are connected to the lead calculation, are simultaneously the disadvantages of the zero test.

It is therefore the object of the present invention,

- to indicate a method of the type initially cited which avoids the disadvantages of the related art; on one hand, the new method is to be cost-effective in regard to the devices necessary for this purpose and simpler in regard to its performance than typical methods, in which a manipulated target and real shells are used; on the other hand, the new method, unlike the previously known zero test, is also to take all facts in connection with the lead calculation into consideration, among other things the internal ballistics of the shell;
- to suggest a device for performing such a method, and
- to indicate a use of the new device.

The individual steps of the method may also be performed at least partially in other sequences.

SUMMARY OF THE INVENTION

In the new method, as in the typical zero test, real targets or manipulated targets are used, and shells and/or their flight path—or more precisely, the beginning and end of the flight path—are optically simulated. However, in contrast to the typical zero test, a lead calculation is performed. Therefore, it is not only tested whether the weapon barrel follows the tracking fire control device, but rather the precision of the lead calculation, including ballistics, is also considered in the test. In addition, unlike the typical zero test, no image recording device on the weapon barrel is necessary, but rather the image recording device is used which is present on the fire control device in any case. The chain target—radar—software lead calculation—data transmission—movement of the weapon—ballistics target is tested.

The advantages achieved therewith are essentially as follows:

- No image recording device is necessary on the weapon barrel.
- The method is not complicated to perform; the aid of specialists is not necessary and the method may also be performed outside of firing ranges.
- The method is environmentally acceptable; there is no damage to the target, and no ammunition is used; therefore, acoustic emissions are also dispensed with.
- The method is cost-effective, since no ammunition, which is generally costly, is fired.

The new method is, as described above, advantageous in many regards, in particular very cost-effective and simple to perform, however,—like the typical zero test—it is only a test method, which provides information about the totality of the aiming errors, including the lead calculation. Therefore, it does not allow any diagnoses about the causes of the aiming errors. Corrections of the aiming errors may therefore only be performed by error compensations, but not by eliminating the causes of the errors. However, this does not reduce the value of the method, since, in the final analysis, only the effect of the weapon system is significant, and it is unimportant whether aiming errors are to be corrected through their causes or by compensation.

The new method includes the following steps:

- A retrospective calculation of the movement states of the target is performed on the basis of multiple measurements, i.e., essentially an empirical travel/time curve, an empirical speed/time curve, and an acceleration/time function of the target are determined.
- An extrapolating calculation of future movement states of the target is performed in a calculation instant on the basis of the retrospective calculation of the movement states of the target, i.e., at least one presumed future travel/time curve of the target is determined.
- Value pairs of due instants and due positions are recorded, namely
  - due instants, in which the target will be located at a specific position and
  - due positions, where the target will presumably be located at the associated due instants.
- Each due position is determined for a specific firing instant, taking into consideration the shell speed and the internal ballistic values of the shell, in such a way that a shell which is fired from the weapon at this firing instant would arrive at the due position at the due instant.
  - The weapon barrel is now continuously aimed in each due instant at the associated due position. In this due instant, a shell fired in the firing instant would be in the due position and the target would presumably be near the due position, so that a hit could be expected.
- During tracking of the target, the image recording device of the fire control device is aimed at the target in any case and therefore continuously records images of the respective due positions lying near the target and their surroundings.
- The weapon continuously transmits data to the data processing facility, which may be positioned on the fire control device, which, from the view of the weapon, describes the actual angular position and/or direction of the weapon barrel, aimed in azimuth and elevation at the aiming point, i.e. an actual direction.

On the basis of the target position and the difference of the position of the fire control device from the position of the weapon, the data processing unit calculates the theoretical correct look direction toward the target from the view of the weapon, i.e., an intended direction.

The angle which forms the difference between intended direction and actual direction corresponds to the deviation between the target and the fictive shell.

The corresponding angular deviation is displayed on an image reproduction device, in that it is represented and/or overlaid as a deviation mark; the position of the deviation mark in relation to a reference point, for example, to the center point of the image or image reproduction device, is determined by the horizontal and vertical components of the deviation and analogously represents the aiming error. The scale used corresponds to the field of vision of the image recording device. The position of the deviation mark is therefore correlated with the aiming error and the aiming error may be read out from the image reproduction device.

As the fire control device tracks the target, is generally desired that the target appears centrally in the image of the image reproduction device. During performance of the new method, the deviation mark travels in the surroundings of the target. The deviation mark may be understood as a visualization of the fictive shell in the respective surroundings of the target.

As explained in more detail above, only the shells [sic] corresponding to internal ballistics are taken into consideration for the calculation of the flight behavior of the shell to be simulated. This is advisable since only the aiming errors, i.e., only the internal behavior of the weapon system, are to be tested using the method.

In the new method, the steps described above are performed continuously and preferably clocked, which is to be understood to mean that the calculation steps for the value pairs of due instants/due positions are performed in calculation instants which are separated from one another by very small and preferably equal intervals of time. The image reproduction device therefore displays the aiming errors of the weapon system continuously for an entire target trajectory.

Each due instant is preferably calculated starting from a calculation instant and is therefore generally not coincident with one of the following calculation instants. For aiming of the weapon barrel in a calculation instant, the corresponding due position must therefore generally be determined by interpolation between due positions, whose associated due instants lie near this calculation instant.

In the new method, the difference of the locations of the fire control device and the weapon must be taken into consideration for the calculations. The method may also be performed if the weapon moves in relation to the fire control device, i.e., is mounted on a traveling tank, for example. In this case, the changing weapon position must be measured continuously and taken into consideration in the calculations.

The forward movement of a weapon in relation to the fire control device described above is not to be confused with oscillatory motions of a weapon which is located on a moving platform, for example on board a ship or tank. Weapons on ships and tanks may perform both forward movements and oscillatory and shaking motions. The ship and/or tank typically has stabilization facilities for compensating such oscillatory motions. In the new method, oscillatory motions which are to be compensated by stabilization facilities are not taken into consideration in the calculations. This means that the test system according to the new method comprises not only the functions of the weapon system between the tracking of the target and the aiming of the weapon barrel, while taking the lead calculation into consideration, but also includes the effect of the stabilization facilities.

For judging the results of the new method, it must be considered that the accuracy performance of the weapon system is generally rather better than may be assumed on the basis of the images appearing on the image reproduction device, firstly, because the antiaircraft guns used as weapons usually have multiple weapon barrels, secondly, because multiple weapons are usually assigned to a fire control device in a weapon system, and thirdly, because spread may always be expected when firing with real shells. However, it must also be considered that the new method does not take external ballistics, which may negatively influence the accuracy performance, into consideration.

To perform the method described above, an image recording device and an image reproduction device, connected to the image recording device via a connection device, are used as well as a data processing unit including software and connection devices must be available.

In a particularly preferred exemplary embodiment of the present invention, the image reproduction device is connected to the image recording device in such a way that the images recorded are immediately displayed continuously.

If the aiming precision according to the new method is tested on a modern weapon system, it may be assumed that the fire control device has an image recording device and an image reproduction device connected thereto available in any case. Therefore, in contrast to the typical zero test, neither an additional image recording device nor an additional image reproduction device has to be provided to perform the method. In general, the data processing unit present in any case is also sufficient, so that only the necessary additional software must be obtained.

A video camera may be used as an image recording device, for example.

The image recording device may be positioned on the fire control device temporarily or permanently.

Generally, as already described, the data processing unit assigned to the weapon system may be used as the data processing unit. This unit may be positioned exclusively on the fire control device or partially on the fire control device and partially on the weapon itself. A separate computer and/or memory unit, possibly separated from the weapon and fire control device, may also be used, which may also possibly be connected in modules.

As described above in more detail, the relative position, i.e. the distance and the relative angle, between the weapon and the fire control device must be known and taken into consideration in the calculations.

If both the weapon and the fire control device are fixed, this relative position is referred to as the gun parallax. The relative position must be determined before the beginning of the method. A position measurement device is used to determine the relative position. This may be a completely external device, like a triangulation device, or an internal device of the weapon system, or a device working together with a GPS.

The relative position between the weapon and the fire control device may, however, also change, for example, if the weapon is mounted on a moving vehicle, for example on a tank, while the fire control device is fixed. In this case, the continuous change of the relative position must be detected and taken into consideration continuously in the calculations which are performed while carrying out the method. The position measurement device may therefore not be a purely external device. The position measurement device is connected to the data processing facility and the software must be implemented for the purpose of considering the continuous change of the relative position in the calculations of the method.

The new method is particularly suitable for judging the aiming errors of weapon systems having multiple weapons and one fire control device. The aiming errors of the various weapons may be visualized simultaneously and may be differentiated if each weapon is assigned a deviation mark which differs from the other deviation marks.

Further characteristics and advantages of the present invention are described in more detail in the following with reference to an example and in relation to the drawing.

DETAILED DESCRIPTION OF THE PREFERRED EMBODIMENTS

The method according to the present invention is described with reference to FIGS. 1 to 6; the procedures are described in a calculation instant Tc; in actuality, these calculations are performed continuously and/or repeatedly in multiple sequential calculation instants, and the image recording device preferably also operates continuously and/or repeatedly in multiple recording instants.

Figure 1:
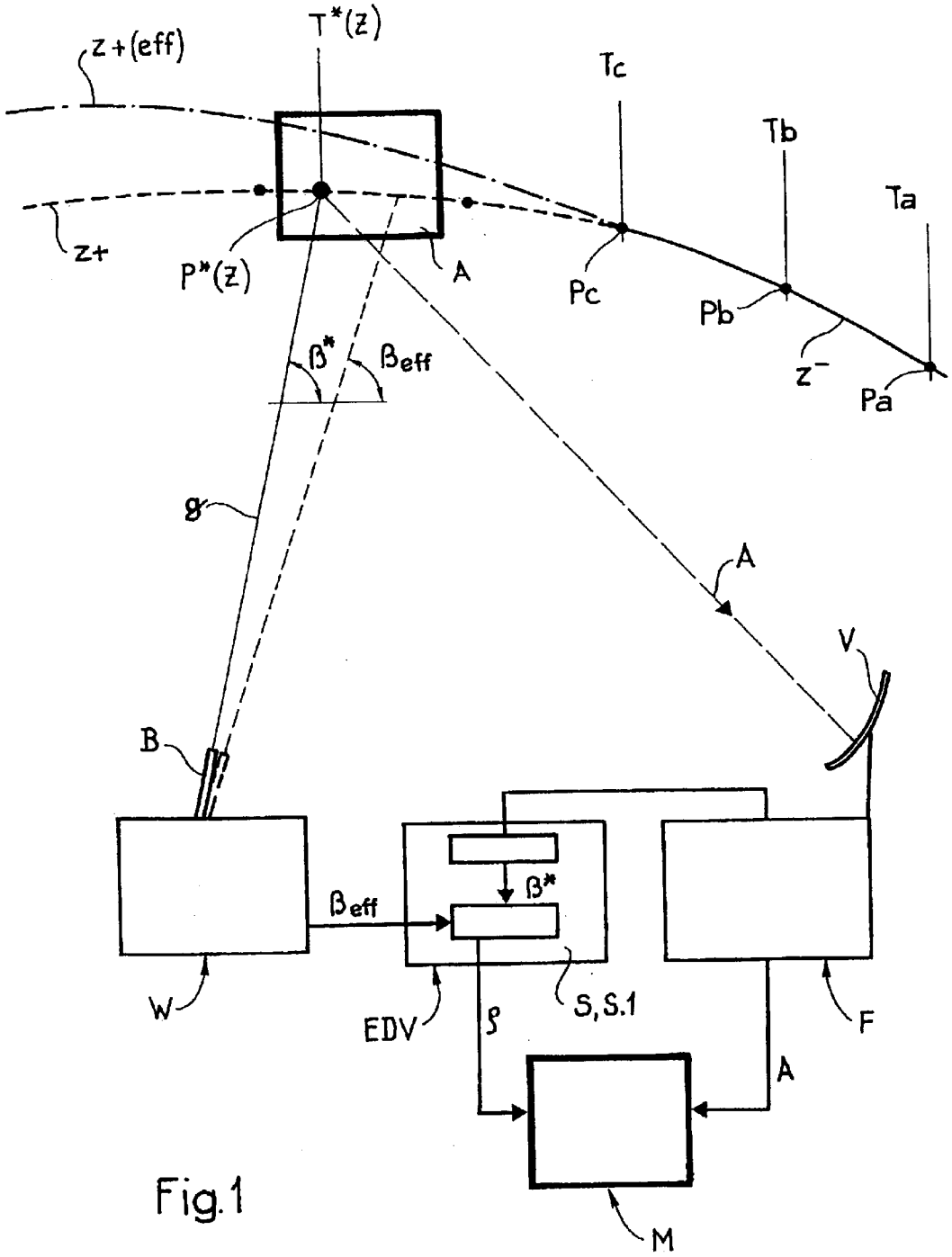
FIG. 1 shows a fixed weapon system, the fire control device and the weapon being located in the same position, as well as a target and a shell in various positions during the performance of the method.

FIG. 1 shows a weapon system whose aiming precision is to be checked and/or whose aiming errors are to be established. The weapon system has a fire control device F and a weapon W having a weapon barrel B and aiming means for aiming the weapon barrel; for the sake of simplicity, it is assumed that fire control device F and weapon W are located at the same position. The weapon barrel axis and its extension going beyond weapon barrel B are indicated with B.1. The weapon is assigned a data processing facility EDV having software S necessary for typical firing operation.

For performing the method according to the present invention, an image recording device V, an image reproduction device M and a computer unit having specific software S.1 are used. Modern weapon systems generally have an image recording device assigned to the fire control device and/or positioned on the fire control device and an associated image reproduction device, which are used for the new method. Data processing facility EDV assigned to the weapon system may be used as a computer unit; specific software S.1 is then implemented in this data processing facility EDV of fire control device F.

Image recording device V is positioned on fire control device F in such a way that it performs the tracking movements of fire control device F, which follow target Z, in solidarity with fire control device F.

Image reproduction device M is, for example, a monitor. It is connected to image recording device V and is intended for the purpose of displaying the images recorded by image recording device V.

The computer unit may be integrated into data processing facility EDV; in general, the function of the computer unit is therefore taken care of by data processing facility EDV of the weapon system, which is present in any case, so that only specific software S.1 is also needed.

FIG. 1 also shows a target Z, which assumes position Pc at instant Tc. Target Z moves on a target trajectory; in FIG. 1, section z−, the section of the target trajectory which the target flew through before instant Tc, is illustrated by a solid line, while section z+ of the target trajectory, which will presumably be flown through after instant Tc, is illustrated by a dashed line; a dot-dash line represents section z+eff of the target trajectory, which the target actually will fly through after instant Tc, but which is not yet known at instant Tc.

Target Z is tracked by fire control device F, and the movement state of target Z is established at the same time. Target Z has assumed position Pa at instant Ta and position Pb at instant Tb. In instant Tc, a processing facility EDV, which is assigned to the weapon system, retrospectively calculates the movement state of target Z, which contains section z− of the target trajectory, up to instant Tc.

In instant Tc, a lead calculation is performed in a way known per se. On the basis of the established movement states of target Z, data processing facility EDV calculates the expected future movement state of target Z, which corresponds to target trajectory z+, through an extrapolation. A due instant T* and an associated due position P* are established in such a way that a shell G, which was fired at instant Tc from a weapon barrel B of a weapon W, would arrive at due position P* in due instant T*. The shell speed and the internal ballistics of shell P are taken into consideration in the calculation. If there is a difference of the position of weapon W from the position of fire control device F, i.e., a gun parallax, then this difference must also be taken into consideration in the calculation. At this due instant T*, target Z is also expected near corresponding due position P*. Target Z will presumably not precisely reach the expected due position, because its actual movement state and/or its actual target trajectory z+eff generally is/are not identical to the calculated movement state and/or calculated target trajectory z+.

The lead calculation is performed continuously. Value pairs P*/T* established for each due instant T* and associated due positions P* of target Z are stored in a memory of data processing facility EDV in a type of table. This table is continuously updated on the basis of further establishments of movement states of target Z, which files further on section z+eff of the target trajectory. As soon as due instant T* is reached, weapon barrel B is aimed at due position P*. However, in general, due instant T* does not exactly coincide with one calculation instant. In this case, the calculation instant directly following due instant T* is used as the due instant. The due position associated with this instant is then determined by interpolation between value pair T*;P* and a value pair neighboring it from the stored value pairs of due positions and due instants. If a real shell G was fired at due position P* in instant Tc, it would fly along a shell trajectory g and would arrive at due position P* in due instant T*. Target Z is located in surroundings A of this due position P* in due instant T*, so that a hit would occur with some certainty, if shell G had actually been fired.

According to the present invention, the continuous aiming of weapon barrel B at the respective due position is not performed, as for firing, at the beginning of the shell flight duration and for the purpose of firing a shell, but only at the end of the shell flight duration and therefore in the respective corresponding due instant.

Weapon W continuously transmits data to data processing facility EDV, describing the position which weapon barrel B assumes from the view of weapon W in respective due instant T*, i.e., data and/or a direction βeff, which describe the actual position of weapon barrel B in due instant T*. In turn, data processing facility EDV calculates, taking into consideration the position of target Z and a difference of the position of fire control device F and weapon W, the theoretical correct looking direction from weapon W to target Z in due instant T*, i.e., data and/or a direction β*, which describe the intended position of weapon barrel B in due instant T*. The difference of βeff and β* is then calculated, from which an angle is obtained, which is referred to as aiming error ρ. Aiming error ρ is determined by its horizontal and vertical components in relation to the look direction of weapon W at target Z.

Figure 2:
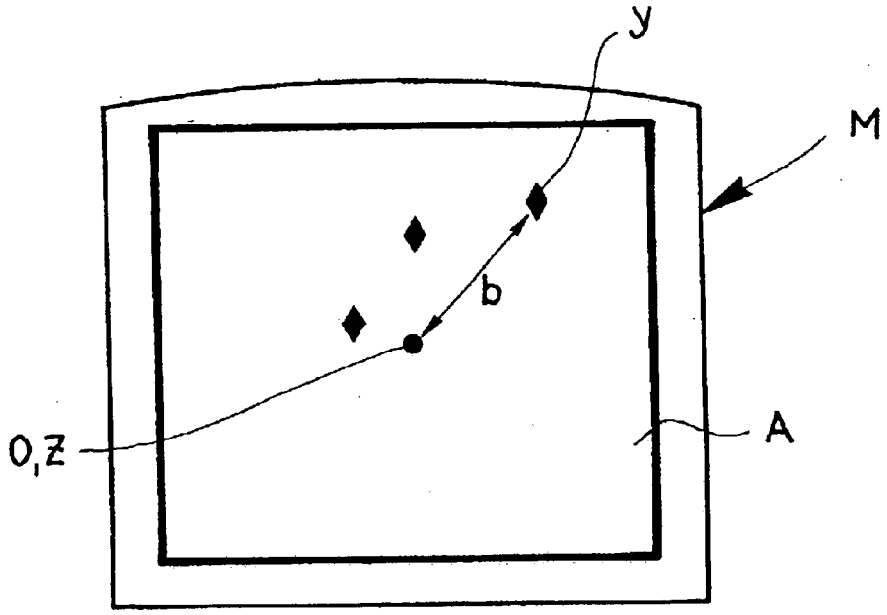
FIG. 2 shows an image reproduction device having a visualized image for a weapon system having a weapon.

As illustrated in FIG. 2, aiming errors ρ are continuously displayed on image reproduction device M; for this purpose, a deviation mark Y is visualized, whose deviation b from a reference point O reproduces aiming error ρ to scale in its horizontal and vertical components in relation to the look direction of weapon W at target Z; generally, the image center is used as reference point O, and the scale used corresponds to the field of vision of the image recording device. An image of target Z is recorded by image recording device V and also visualized with the aid of image reproduction device M.

Therefore, the image of actual target Z and deviation mark Y, representing the aiming error, are continuously displayed simultaneously on the image reproduced on image reproduction device M of space A surrounding the target.

Fire control device F generally tracks target Z in such a way that target Z at least approximately falls on reference point O on the reproduced image. Deviation mark Y may then be interpreted as shell G and/or as the end of shell trajectory g, so that the representation of aiming error ρ is very graphic. Since the various steps of the method are performed continuously, deviation mark Y generally travels in the region of visualized target Z.

Figure 3:
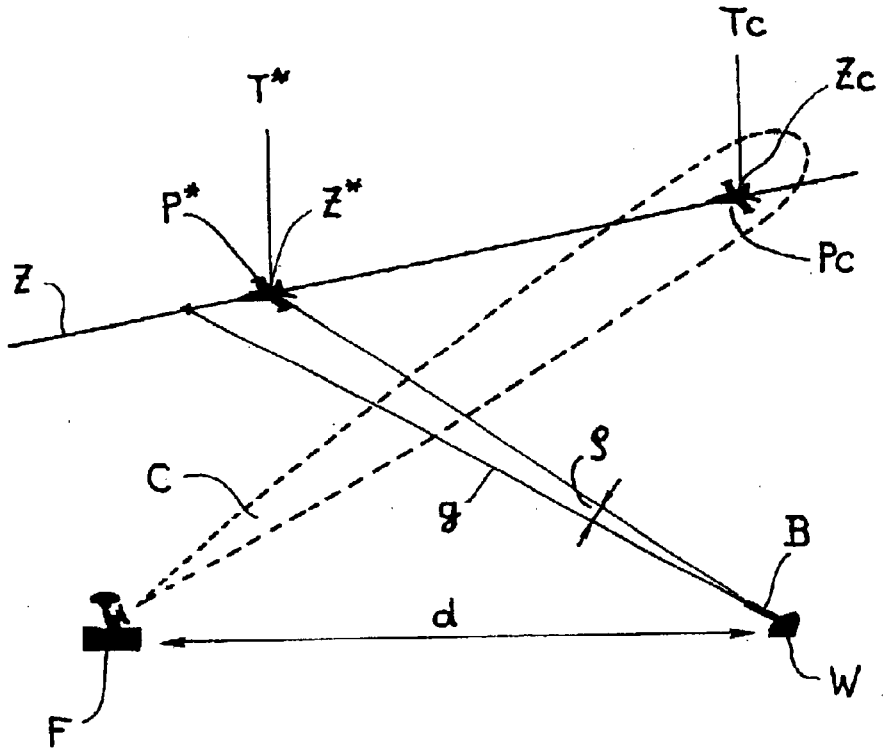
FIG. 3 shows a fixed weapon system, the fire control device and the weapon not being located in the same position, as well as a target and a shell in various positions during performance of the method.

The procedures described above are illustrated once again with the aid of FIG. 3, which is not to scale, however, it is assumed here that a distance d lies between fire control device F and weapon W. The relative position of fire control device F and weapon W is measured by a position measurement device W-F; this may be an internal position measurement device of the weapon system or a completely external position measurement device.

At instant Tc, fire control device F, and/or its search and tracking unit, is active in a region C and target Z is located at position Pc. Weapon barrel B would be aimed at due position P*, if there was the intention of firing a shell G; this shell G would still be in weapon barrel B at the beginning of its shell trajectory g, which it would fly through after firing. In due instant T*, i.e., after completion of the shell flight duration, during which shell G would be underway, target Z is near due position P* and weapon barrel B is aimed at due position P*. The aiming error is shown in FIG. 3 as angle ρ.

Figure 4:
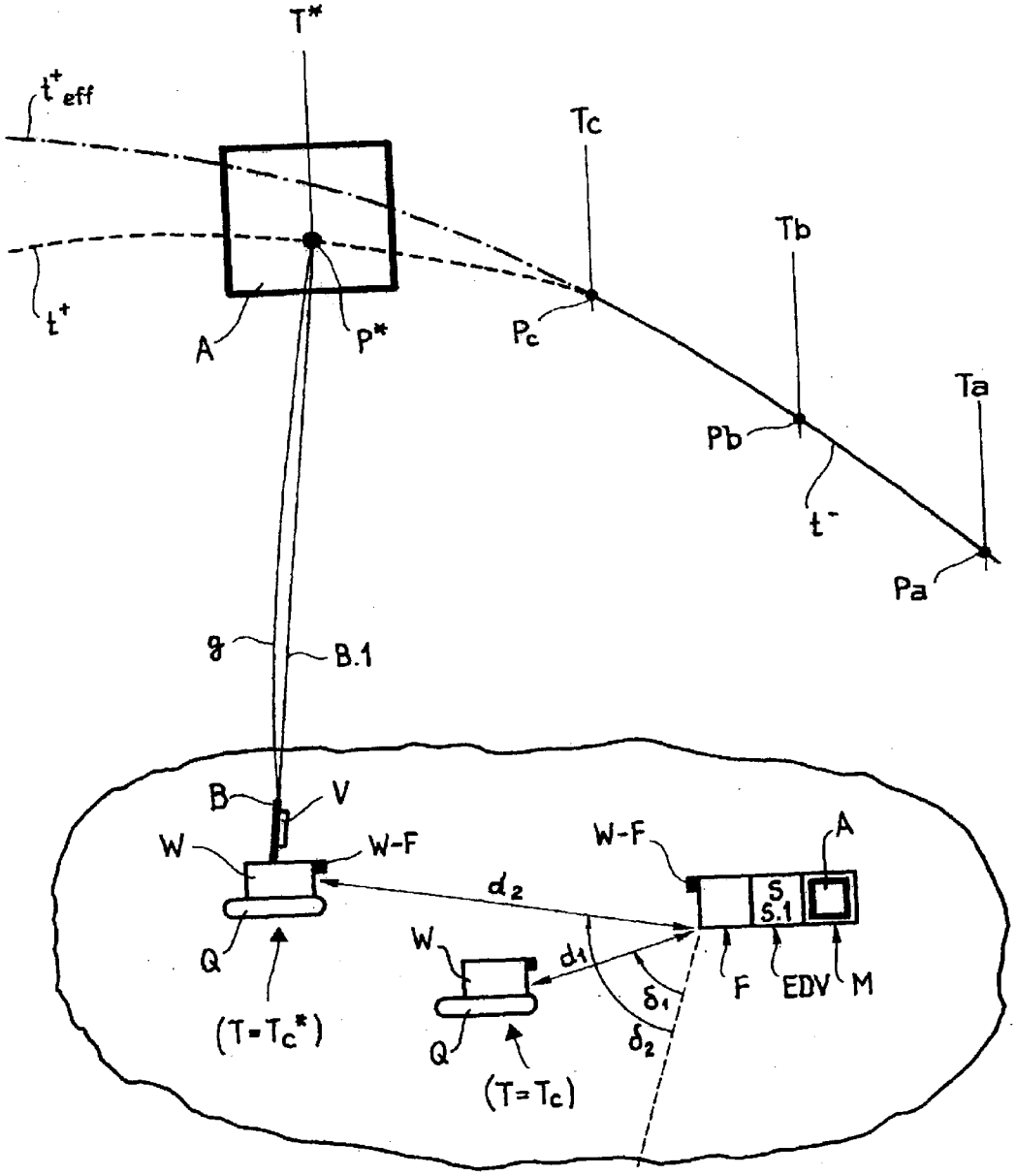
FIG. 4 shows a weapon system having a weapon mounted on a moving vehicle in two positions and a fixed fire control device, as well as a target and a shell in various positions during performance of the method.

FIG. 4 shows a weapon system having a fixed fire control device F and a weapon W mounted on a moving vehicle Q, which is illustrated in two positions; distance d and relative angle δ between fire control device F and weapon W change over time; at instant Tc, they are d1 and δ1 and at instant T*, they are d2 and δ2. Weapon system W has an internal position measurement device W-F or a position measurement device W-F, which works together with a GPS, which is connected to data processing facility EDV. Software S.1 is also implemented for the purpose of considering the continuous change of distance d and relative angle δ between weapon W and fire control device F in the calculations.

Figure 5:
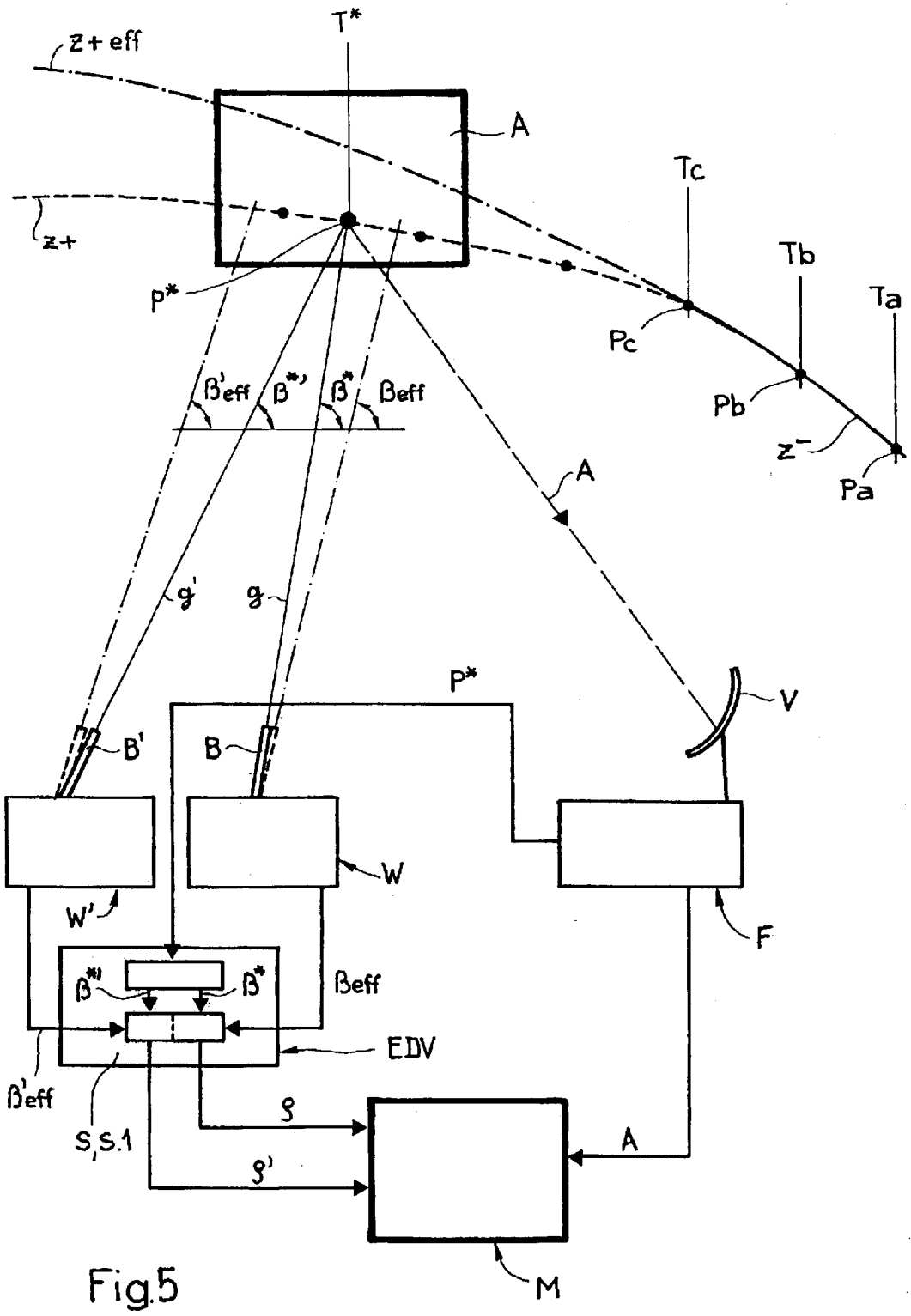
FIG. 5 shows a weapon system having two weapons aimed at a shared target, in the same illustration as in FIG. 1.
Figure 6:
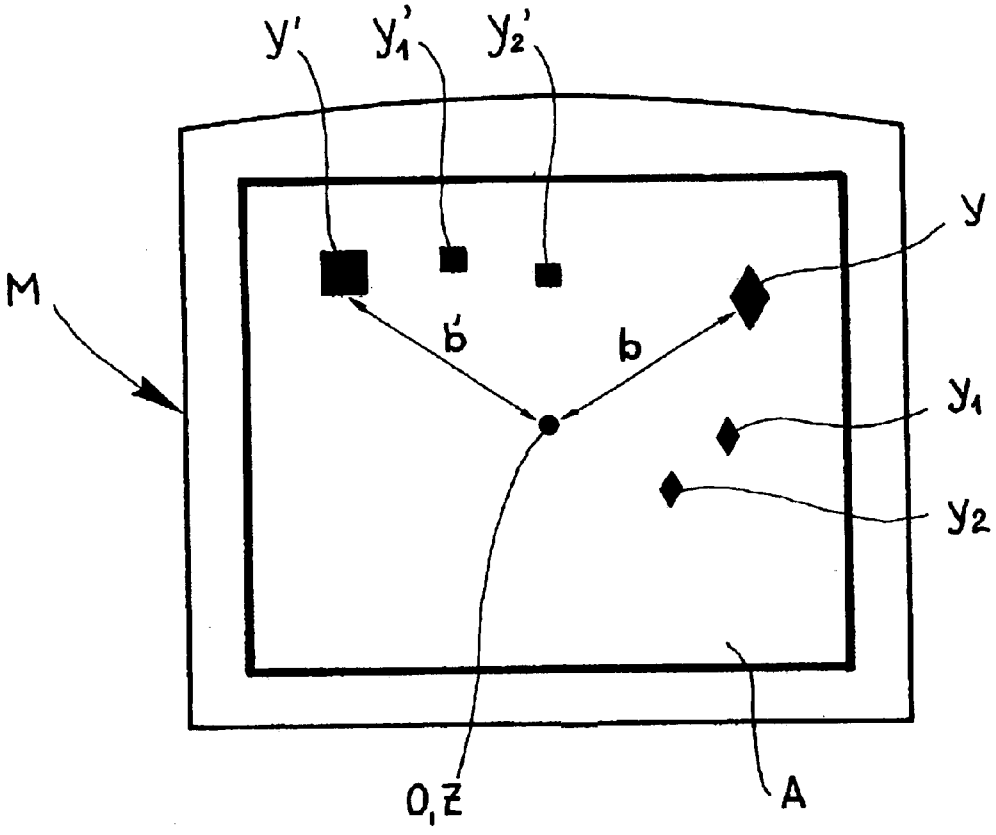
FIG. 6 shows an image reproduction device having a visualized image for a weapon system having two weapons.

FIG. 5 shows a further weapon system, which comprises fire control device F, weapon W and an additional weapon W'. The method according to the present invention runs as follows here: all steps which only relate to target Z and/or the movements of target Z apply to both weapon W and to weapon W'. All calculations which relate to either weapon W or weapon W' are performed separately. In particular, target trajectories z−, z+ are established for target Z. Taking the positions of weapon W and/or W' into consideration, due times T and/or T*', as well as associated due positions P*c, P*' are determined and weapons W and W' are aimed accordingly. For weapon W, the actual direction and the intended direction of weapon barrel B and/or directions βeff and β*, each from the view of weapon W, as well as their difference, i.e., aiming error ρ' are determined. In the same way, βeff', β*', and ρ' are determined for weapon W'. As shown in FIG. 6, aiming error ρ of weapon W and aiming error ρ' of further weapon W' are displayed on monitor M, further weapon W' being assigned a deviation mark Y' which differs in its shape and/or color from deviation mark Y. Deviation marks travel in the surroundings of reference point O and/or of target Z; deviation mark Y is shown in later instants using Y1, Y2, and deviation mark Y' is shown in later instants using Y1', Y2'.

What is claimed is:

1. A method for judging the aiming error of a weapon system, this weapon system having a fire control device for tracking a target, a weapon having a weapon barrel, aiming means for aiming the weapon barrel, and a data processing facility, the method comprising the steps of:

the fire control device tracking the target, the data processing facility repeatedly performing a lead calculation, the weapon barrel being aimed on the basis of the lead calculation, the data processing facility obtaining a signal from the weapon about an actual direction of the aimed weapon barrel from the view of the weapon and taking into consideration a difference between the fire control device and the weapon (W), calculating an intended direction of the weapon barrel from the view of the weapon, and calculating the aiming error as a difference between the actual direction and the intended direction, an image recording device recording images of the target and its surroundings, and an image reproduction device displaying the images recorded by the image recording device and a deviation mark in a deviation from a reference point, this deviation being correlated with the aiming error.

2. The method according to claim 1, characterized in that the fire control device repeatedly performs measurements while tracking the target, in order to detect positions of the target and instants at which the target assumes these positions, the data processing facility, in an instant selected as a calculation instant, continuously calculates the current movement state of the target, based on the measurements of the fire control device, calculates the expected future movement state of the target, based on the current movement state of the target, determines due instants and associated due positions, taking into consideration a difference of the positions of weapon and fire control device as well as the speed and the internal ballistics of usable shells, in such a way that, in the due instant, a shell which was fired in the calculation instant would arrive at the due position and the target arrives at the surroundings of the due position, upon reaching the due instant, makes a signal available to the aiming means for aiming the weapon barrel, and the aiming of the weapon barrel at this due position is performed in this due instant.

3. The method according to claim 1, characterized in that delays caused by the method, particularly delays in the transmission of signals and performing movements during aiming of the weapon barrel, are taken into consideration in calculations.

4. The method according to claim 1, characterized in that the difference between the weapon and the fire control device is measured repeatedly and changes of this difference due to forward movement of the weapon are considered in the calculations.

5. The method according to claim 1, the weapon system including a further weapon, characterized in that calculations relating to the further weapon are performed analogously to the calculations relating to the first weapon described, and the further weapon is assigned a further deviation mark, in order to visualize its aiming error in synchronization with the aiming error of the first weapon described.

6. A device for judging the aiming errors of a weapon system, having:

a fire control device for tracking a target, a weapon having a weapon barrel, aiming means for aiming the weapon barrel, and a data processing facility having software, the fire control device having a sensor device, in order to measure the respective positions of the target, and the data processing facility being implemented for the purpose of repeatedly performing a lead calculation in order to establish a due instant and a due position and, upon reaching the due instant, making a signal available to the aiming means in order to aim the weapon barrel at the due position, this device—further comprising:

an image recording device, positioned on the fire control device, to record images of the target, an image reproduction device, in order to visualize the recorded images and a deviation mark representing the aiming error at a deviation from a reference point, the data processing facility having software, in order to receive a position signal from the weapon, which describes an actual direction of the weapon barrel from the view of the weapon, taking into consideration the difference between the weapon and the fire control device, calculate an intended direction of the weapon barrel from the view of the weapon, calculate the difference of the actual direction and the intended direction, which corresponds to the aiming error, and make a signal corresponding to this difference available to the image reproduction device, and the image reproduction device being implemented for the purpose of reproducing the deviation of the deviation mark from the reference point, which may be interpreted as an aiming error, on the basis of this signal.

7. The device according to claim 6, characterized in that the image reproduction device is implemented and connected to the image recording device in such a way that the images are recorded repeatedly and/or displayed immediately.

8. The device according to claim 6, characterized in that the image recording device is a video camera.

9. The device according to claim 6, characterized in that the image reproduction device is a monitor.

10. The device according to claim 6, characterized in that it has a position measurement device in order to measure the change of a position of the weapon in the event of forward movement of the weapon relative to the fire control device, the data processing unit is implemented for the purpose of considering the change of the position of the weapon in calculations.

11. The device according to claim 10, characterized in that the position measurement device is an internal device of the weapon system.

12. The device according to claim 10, characterized in that the position measurement device is a device which works together with external means.

13. The device according to claim 6, the weapon system including a further weapon, characterized in that, the software is implemented for the purpose of performing the calculations relating to the further weapon analogously to the calculations relating to the first weapon described, and the image reproduction device is implemented in such a way that the further weapon is assigned a deviation mark which differs from the deviation mark in order to represent the aiming error of the further weapon simultaneously with the representation of the aiming error ($\rho$) of the weapon.

14. The device according to claim 6, characterized in that the weapon is mounted on a vehicle and the fire control device is fixed.

15. The device according claim 6, characterized in that the weapon and the fire control device are mounted on a vehicle.

16. The device according to claim 6, characterized in that the weapon is mounted on a vehicle which performs oscillatory and/or shaking movements and is stabilized relative to this vehicle with the aid of a stabilization device.

* * * * *